US005379762A

United States Patent [19]

Kobayashi

[11] Patent Number: 5,379,762

[45] Date of Patent: Jan. 10, 1995

[54] MOUTHPIECE UNIT OF DIVING RESPIRATOR

[75] Inventor: Kazunori Kobayashi, Tokyo, Japan

[73] Assignee: Grand Bleu International, Inc., New York, N.Y.

[21] Appl. No.: 940,298

[22] Filed: Sep. 3, 1992

[30] Foreign Application Priority Data

Jul. 2, 1992 [JP] Japan ..... 4-197500

[51] Int. Cl.[6] ..... A62B 18/10

[52] U.S. Cl. ..... 128/201.28; 128/204.26; 128/205.24

[58] Field of Search ..... 128/201.28, 204.26, 128/205.24; 137/492.5, 495, 489.5, 614.19, 614.2, 907, 908

[56] References Cited

U.S. PATENT DOCUMENTS

| | | | |
|---|---|---|---|
| 439,093 | 10/1890 | Barian | 128/205.24 |
| 1,331,601 | 2/1920 | Watanabe | 128/205.24 |
| 1,848,234 | 3/1932 | Swope et al. | 128/205.24 |
| 2,152,110 | 3/1939 | Töpper | 128/201.28 |
| 2,821,980 | 2/1958 | Westell | 137/495 |
| 2,874,692 | 2/1959 | Galeazzi | 128/205.24 |
| 2,893,381 | 7/1959 | Black | 137/495 |
| 3,348,540 | 10/1967 | Cullity | 137/908 |
| 3,973,588 | 8/1976 | Holst | 128/201.28 |
| 4,041,977 | 8/1977 | Matsuno | 137/908 |
| 4,178,961 | 12/1979 | Warncke | 128/204.26 |
| 4,297,998 | 11/1981 | Christianson | 128/205.24 |
| 4,345,592 | 8/1982 | Giorgini et al. | 128/205.24 |
| 4,345,593 | 8/1982 | Sullivan | 128/205.24 |
| 4,693,242 | 9/1987 | Biard | 128/204.26 |
| 4,711,263 | 12/1987 | Ottestad | 128/204.26 |
| 4,840,199 | 6/1989 | Brunt, Jr. | 128/205.24 |
| 4,971,108 | 11/1990 | Gottlieb | 137/495 |

*Primary Examiner*—Edgar S. Burr
*Assistant Examiner*—Aaron J. Lewis
*Attorney, Agent, or Firm*—Darby & Darby

[57] ABSTRACT

A mouthpiece unit of a diving respirator wherein a device for opening and closing an aperture of a mouthpiece side of a mouthpiece unit body is provided, and a part of a respirable gas for operating the device is applied to the device through a valve which is opened by the jaw of a diver and a pilot valve which is opened by an inspiration of the diver. A water exhaust port communicating with a gas room of a mouthpiece side formed in the mouthpiece unit body and a valve for closing the water exhaust port are provided on the mouthpiece unit body, the valve being opened when the gas room is increased in pressure.

6 Claims, 1 Drawing Sheet

MOUTHPIECE UNIT OF DIVING RESPIRATOR

BACKGROUND OF THE INVENTION

1. Field of the Invention

The present invention relates to a mouthpiece unit of a diving respirator, and more particularly relates to a mouthpiece unit having a valve for opening and closing an aperture of a mouthpiece side of a mouthpiece unit body.

2. Description of the Prior Art

In a conventional mouthpiece unit of a diving respirator, a manually operatable valve for closing a mouthpiece is provided in order to prevent water from invading into the mouthpiece unit through the mouthpiece, when the mouthpiece is off the mouth of the diver in the water.

As stated above, in the conventional mouthpiece unit of the diving respirator, the valve of the mouthpiece unit is operated manually, so that the diver must be skilled in the operation of such valve and such valve is unsuitable for the general diver.

Accordingly, a new mouthpiece unit has been proposed. In such new mouthpiece unit, a valve is mounted on a mouthpiece unit body for opening and closing an aperture in the mouthpiece unit body and an operation lever for operating the valve is projected from the mouthpiece unit body so that the operation lever can be operated against a spring force by the jaw of a diver, when a mouthpiece of the mouthpiece unit is held in the diver's mouth.

However, in such new mouthpiece unit, a considerable force is required to operate the operation lever, so that the jaw of the diver get tired.

SUMMARY OF THE INVENTION

It is an object of the present invention to provide an improved mouthpiece unit of a diving respirator solved the above-described problems.

The above-described object can be attained by a mouthpiece unit of a diving respirator comprising a mouthpiece unit body, means for opening and closing an aperture formed on said mouthpiece unit body between a mouthpiece and an inspiration opening formed on said mouthpiece unit body, a gas supply port for supplying a respirable gas into said mouthpiece unit body, a pilot valve which is operated by a pressure change in a gas room of a mouthpiece side formed in said mouthpiece unit body to apply a part of the respirable gas to said means to open said aperture, and a valve for opening and closing said gas supply port, which is operated by an operation lever projected to the outside of said mouthpiece unit body.

The above-described object can also be attained by a mouthpiece unit of a diving respirator comprising a mouthpiece unit body, means for opening and closing an aperture formed on said mouthpiece unit body between a mouthpiece and an inspiration opening formed on said mouthpiece unit body, which is operated to open said aperture when a gas room of a mouthpiece side formed in the mouthpiece unit body is reduced in pressure, a water exhaust port provided on said mouthpiece unit body for communicating said gas room with the outside of the mouthpiece unit body, and a valve normally closing said water exhaust port, which is operated when said gas room is increased in pressure to open said water exhaust port.

The above and other objects as well as advantageous feature of the present invention will become apparent from the following description of the embodiment taken in conjunction with the accompanying drawing.

DESCRIPTION OF THE PREFERRED EMBODIMENT

Figure 1:
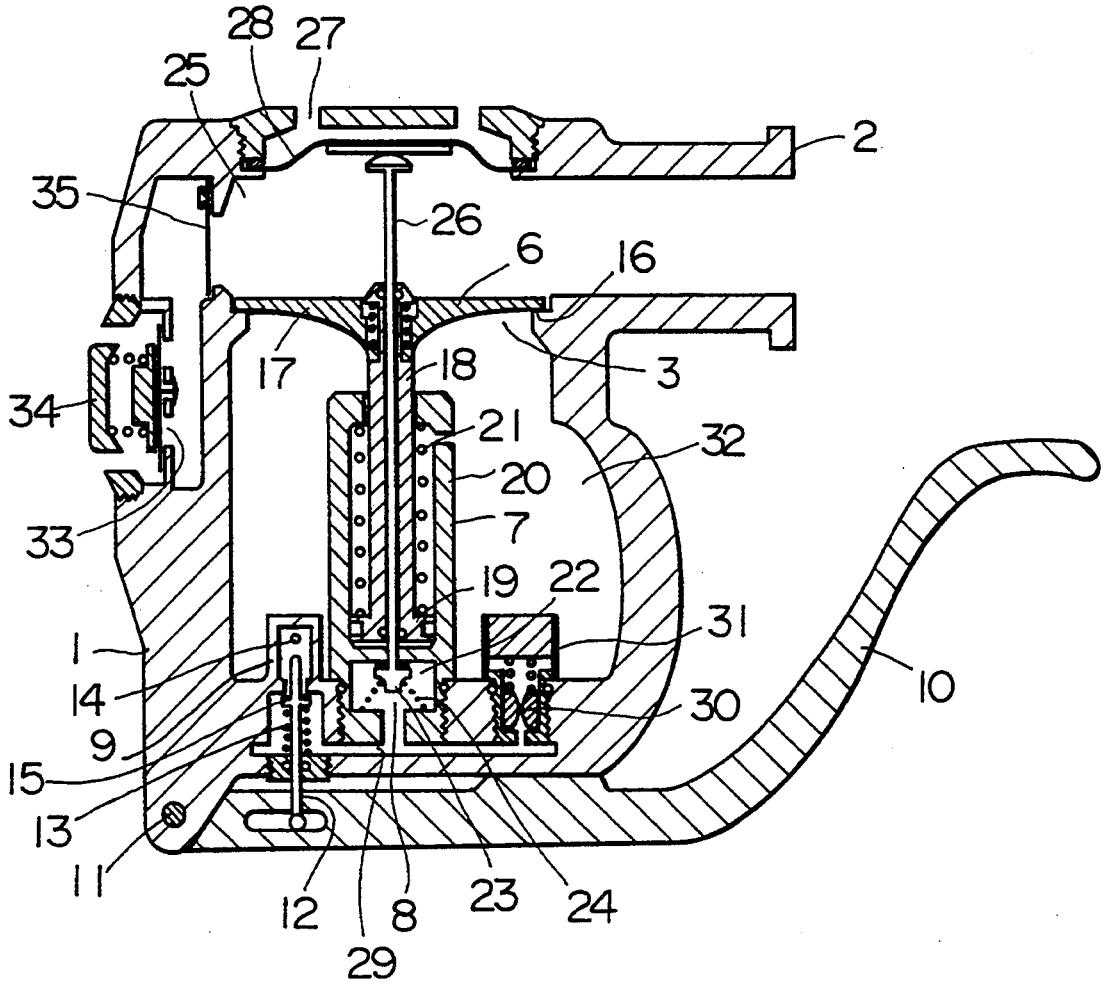
FIG. 1 is a vertically sectional front view of a mouthpiece unit of a diving respirator according to the present invention.
Figure 2:
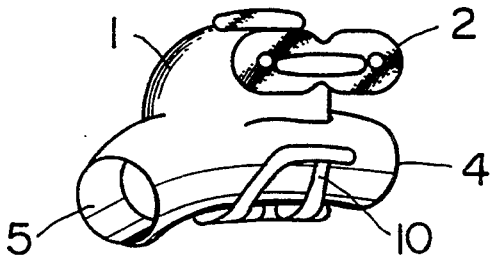
FIG. 2 is a perspective view of the mouthpiece unit of the diving respirator of the present invention.

In FIGS. 1 and 2, reference numeral 1 denotes a mouthpiece unit body, 2 is a mouthpiece formed on said mouthpiece unit body 1, 3 is an aperture formed on the mouthpiece unit body 1 between said mouthpiece 2 and an inspiration opening 4 formed on the mouthpiece unit body 1, and 5 is an expiration opening formed on the mouthpiece unit body 1.

A mouthpiece unit of the present invention comprises a first valve 6 for opening and closing the aperture 3, operating means 7 for operating said first valve 6, pilot valve means 8 inserted between said operating means 7 and a gas source (not shown) of a respirable gas, such as oxygen, and a second valve 9 for opening and closing a gas supply port 14 connected to said gas source.

The mouthpiece unit of the present invention further comprises an operation lever 10 projected from the mouthpiece unit body 1 for operating said second valve 9 for opening and closing the gas supply port 14, a pin 11 fixed to the mouthpiece unit body 1 for supporting rotatably a base end of said operation lever 10 so that a free end of said operation lever 10 is positioned so as to be pushed down by the jaw of the diver when the mouthpiece 2 is held in the diver's mouth, a link 12 pivotably connected at one end thereof to a base portion of said operation lever 10 and connected at the other end thereof to a valve body 15 of said second valve 9, and a spring 13 for urging said valve body 15 to close the gas supply port 14. Said valve body 15 of said second valve 9 is moved against the spring force of said spring 13 to open the gas supply port 14 when said operation lever 10 is pushed down by the jaw of the diver.

Said first valve 6 comprises a valve seat 16 formed on the mouthpiece unit body 1, and a valve plate 17 which is brought into contact with said valve seat 16 to close the aperture 3 and detached from the valve seat 16 to open the aperture 3.

Said operating means 7 comprises a piston rod 18 fixedly secured at one end thereof to a center portion of said valve plate 17 and connected at the other end thereof to a piston 19, a piston cylinder 20 for said piston 19, and a compression spring 21 disposed in said piston cylinder 20 for urging normally said valve plate 17 toward said valve seat 16, said piston 19 being urged by part of the respirable gas.

Said pilot valve means 8 comprises a pilot gas passage 22 for supplying a part of the respirable gas from the respirable gas supply port 14 to an outer end face of said piston 19 in the piston cylinder 20, a pilot valve body 23 for closing the pilot gas passage 22, a pilot spring 24 for urging normally said pilot valve body 23 so as to close said pilot gas passage 22, a pilot rod 26 connected at one end thereof to said pilot valve body 23 and extending into a gas room 25 of a mouthpiece side formed in the mouthpiece unit body 1 between said aperture 3 and said mouthpiece 2, passing through said piston 19, piston rod 18 and valve plate 17, an outside opening 27 formed on said mouthpiece unit body 1 at a position facing the other end of said pilot rod 26 in said gas room 25, and a diaphragm 28 interposed between said other end of said pilot rod 26 and said outside opening 27 in said gas room 25.

When the diver inspires and accordingly the gas room 25 is reduced in pressure, said diaphragm 28 is moved inwardly by the outside pressure and said pilot rod 26 is pushed down against the force of the pilot spring 24, so that said pilot valve body 28 is moved to open the pilot gas passage 22.

Further, the respirable gas, such as oxygen is supplied from the respirable gas supply port 14 to a gas room 32 of an inspiration side formed on the mouthpiece unit body 1 between said aperture 3 and said inspiration opening 4 through a main gas passage 29, an orifice valve 30, and a non-return valve 31.

A water exhaust port 33 is provided on said mouthpiece unit body 1 for communicating said gas room 25 of the mouthpiece side with the outside of the mouthpiece unit body 1. The water exhaust port 33 is closed by a normally closed valve 34 which is operated by a pressure difference between the gas room 25 of the mouthpiece side and the outside of the mouthpiece unit body 1. A non-return valve 35 is inserted between said water exhaust port 33 and the gas room 25.

In the mouthpiece unit of the diving respirator of the present invention constructed as above, when the mouthpiece 2 is held by the diver's mouth the operation lever 10 is pushed down by the jaw of the diver and rotated centering around the pin 11 in FIG. 1, so that the valve body 15 of the second valve 9 is pulled via the link 12 against the force 25 of the spring 13 to open the gas supply port 14. As a result, a respirable gas, such as oxygen reduced to $5\sim8$ kg/cm$^2$ and supplied from the respirable gas supply port 14 is fed to the pilot gas passage 22 and the main gas passage 29.

The respirable gas supplied into the main gas passage 29 enters into the gas room 32 of the inspiration side through the orifice valve 30 and the non-return valve 31 to form a stand-by state. In such state, if the diver inspires through the mouthpiece 2 the gas room 25 of the mouthpiece side is reduced in pressure, so that the diaphragm 28 is moved inwardly by the outside pressure and the pilot rod 26 is pushed down against the force of the pilot spring 24.

As a result, the pilot valve body 23 is moved to open the pilot gas passage 22, so that the gas in the pilot gas passage 22 is applied to the outer end face of the piston 19 in the piston cylinder 20. Thus, the piston 19 is pushed up against the force of the spring 21, so that the valve plate 17 of the first valve 6 is separated from the valve seat 16 to open the aperture 3 of the mouthpiece side and continue the inspiration.

In case that the gas room 25 of the mouthpiece side is invaded with water, if the expiration gas is supplied by the diver into said gas room 25 prior to the diver's inspiration said non-return valve 35 and said normally closed valve 84 are opened to discharge the water from the gas room 25 through said water exhaust port 38 and accordingly the diver's inspiration can be done.

When the mouthpiece 2 is off the mouth of the diver, the operation lever 10 is separated from the jaw of the diver at the same time and returned to the original position due to the force of the spring 13. As a result, the second valve 9 is operated to close the gas supply port 14 and the supply of the respiration gas to the pilot gas passage 22 is stopped, so that the aperture 3 is closed by the valve plate 17 of the second valve 6 by the action of the spring 21 and water is prevented from entering into the gas room 32 of the inspiration side through the mouthpiece 2.

Further, if the gas supplied from the respirable gas supply port 14 is reduced in pressure (in case of the lack of gas), the degree of open of the aperture 3 of the mouthpiece side depending on the position of the valve plate 17 becomes small because the force for pushing up the piston 19 of the operating means 7 decreases, so that the diver feels choky and accordingly the dangerous due to the lack of the respirable gas can be prevented from occurring.

EFFECT OF THE INVENTION

As stated above, according to the mouthpiece unit of the diving respirator of the present invention the operating means 7 for opening and closing the aperture 3 of the mouthpiece side of the mouthpiece unit body is operated by using a part of respirable gas to be introduced into the gas room 82 of the inspiration side of the mouthpiece unit body, and the second valve 9 for controlling the introduction of the respirable gas is operated by the jaw of the diver via the projected operation lever 10, so that no large stress is exerted on the jaw of the diver and the respiration can be continued stably with safe.

What is claimed is:

1. A mouthpiece unit of a diving respirator comprising:

a housing having an inhalation opening;

a mouthpiece formed on said housing and selectively communicating with said inhalation opening by an aperture, said mouthpiece having a chamber;

a gas supply port for supplying a respirable gas into said housing;

a lever pivotably attached to said housing extending to the outside of said housing, said lever movable from a first position to a second position, said lever remaining in said second position only while manually held in said second position by a user;

a gas supply valve for opening and closing said gas supply port, said gas supply valve operable by said lever, said gas supply valve being open only when said lever is in said second position and closed when said lever is said first position;

an aperture opening means for selectively opening said aperture; and a pilot valve operable by a pressure change in said chamber for applying respirable gas to said aperture opening means, said aperture opening means responsive to the application of gas by said pilot valve.

2. The mouthpiece unit of the diving respirator as claimed in claim 1, wherein said aperture opening means comprises a valve seat formed on the housing, a valve plate which is brought into contact with said valve seat to close the aperture and detached from the valve seat to open the aperture, a piston rod fixedly secured at one end thereof to a center portion of said valve plate and connected at the other end thereof to a piston, a piston cylinder for said piston, and a compression spring disposed in said piston cylinder for urging normally said valve plate toward said valve seat, said piston being urged by a part of a respirable gas.

3. The mouthpiece unit of the diving respirator as claimed in claim 1, wherein said pilot valve comprises a pilot gas passage for supplying respirable gas from the respirable gas supply port to an outer end face of said piston in the piston cylinder, a pilot valve body for closing the pilot gas passage, a pilot spring for urging normally said pilot valve body so as to close said pilot gas passage, a pilot rod connected at one end thereof to said pilot valve body and extending into said chamber, passing through said piston, piston rod and valve plate, an outside opening formed on said housing at a position facing the other end of said pilot rod, and a diaphragm interposed between said other end of said pilot rod and said outside opening.

4. The mouthpiece unit of the diving respirator as claimed in claim 1, wherein said gas supply valve comprises said lever a base end of said lever rotatably supported and a free end of said lever positioned so as to be pushed down by the jaw of a diver when the mouthpiece is held in the diver's mouth, a valve body, and a spring for urging said valve body to close said gas supply port, said valve body being moved against the spring force to open the gas supply port when said lever is pushed down by the jaw of the diver.

5. A mouthpiece unit of a diving respirator comprising:

a housing having an inhalation opening:

a mouthpiece formed on said housing and selectively communicating with said inhalation opening by an apertures said mouthpiece having a chamber;

an aperture opening means for selectively opening said aperture;

a pilot valve operable by a pressure change in said chamber for applying respirable gas to said aperture opening means, said aperture opening means responsive to the application of gas by said pilot valve;

a gas supply port for supplying a respirable gas into said housing;

a lever pivotably attached to said housing extending to the outside of said housing, said lever movable from a first position to a second position, said lever remaining in said second position only while manually held in said second position by a user;

a gas supply valve for opening said gas supply port, said gas supply valve operable by said lever, said gas supply valve being open only when said lever is in said second position and closed when said lever is in said first position;

a water exhaust port provided on said housing for communicating said chamber with the outside of the mouthpiece unit body; and a valve normally closing said water exhaust port, operable when said chamber is increased in pressure to open said water exhaust port.

6. The mouthpiece unit of the diving respirator as claimed in claim 5, wherein said aperture opening means comprises a valve seat formed on said housing, a valve plate which is brought into contact with said valve seat to close the aperture and detached from the valve seat to open the aperture, a piston rod fixedly secured at one end thereof to a center portion of said valve plate and connected at the other end thereof to a piston, a piston cylinder for said piston, and a compression spring disposed in said piston cylinder for urging normally said valve plate toward said valve seat, said piston being urged by respirable gas.

* * * * *